US010655932B2

(12) United States Patent
Jeung et al.

(10) Patent No.: US 10,655,932 B2
(45) Date of Patent: May 19, 2020

(54) DOT SIGHTING DEVICE

(71) Applicant: Bo Sun Jeung, Bucheon-si (KR)

(72) Inventors: Bo Sun Jeung, Bucheon-si (KR); In Jung, Bucheon-si (KR); Dong Hee Lee, Seongnam-si (KR)

(73) Assignee: Bo Sun Jeung, Bucheon-si, Gyeonggi (KR)

( * ) Notice: Subject to any disclaimer, the term of this patent is extended or adjusted under 35 U.S.C. 154(b) by 0 days.

(21) Appl. No.: 16/297,008

(22) Filed: Mar. 8, 2019

(65) Prior Publication Data

US 2019/0204047 A1 Jul. 4, 2019

Related U.S. Application Data

(63) Continuation of application No. 14/565,188, filed on Dec. 9, 2014, now Pat. No. 10,228,217.

(30) Foreign Application Priority Data

Dec. 13, 2013 (KR) ..... 10-2013-0155453

(51) Int. Cl.
*F41G 1/30* (2006.01)

(52) U.S. Cl.
CPC ..... *F41G 1/30* (2013.01)

(58) Field of Classification Search
CPC ..... F41G 1/30; F41G 1/245
See application file for complete search history.

(56) References Cited

U.S. PATENT DOCUMENTS 2,190,567 A 2/1940 Jung
2,190,569 A 2/1940 MacGill
2,419,151 A 4/1947 Miles
2,986,972 A 6/1961 Miles
3,524,710 A 8/1970 Rickert
3,672,782 A 6/1972 Akin
3,867,764 A 2/1975 Dunmire et al.
3,905,708 A 9/1975 Steck, III
3,914,030 A 10/1975 Weiss
3,963,356 A 6/1976 Wiklund
4,269,476 A 5/1981 Gauthier et al.
4,417,814 A 11/1983 Doliber
4,600,271 A 7/1986 Boyer et al.
(Continued)

FOREIGN PATENT DOCUMENTS

GB 2190569 A 11/1987
GB 2419151 A 4/2006
KR 10-1116269 B1 3/2012

OTHER PUBLICATIONS

An Official Action issued from the Japan Patent Office dated May 22, 2019 in connection with Japanese patent application No. 2016-559136.

(Continued)

*Primary Examiner* — Benjamin P Lee
(74) *Attorney, Agent, or Firm* — Baker & MacKenzie

(57) ABSTRACT

A dot sighting device includes a housing, a light source, a beam splitter and a reflective element. The housing has a first opening and a second opening. A first axis is defined from the first opening to the second opening. The light source emits light. The beam splitter includes a surface that reflects at least a portion of a first light component and transmits at least a portion of a second light component. The second light component is defined as light that enters the housing through the first opening.

20 Claims, 8 Drawing Sheets

(56) References Cited

U.S. PATENT DOCUMENTS

| | | | |
|---|---|---|---|
| 4,704,018 | A | 11/1987 | Takhashi |
| 4,764,011 | A | 8/1988 | Goldstein |
| 5,205,044 | A | 4/1993 | DePaoli |
| 5,272,514 | A | 12/1993 | Dor |
| 5,373,644 | A | 12/1994 | DePaoli |
| 5,493,450 | A | 2/1996 | Ekstrand |
| 5,508,843 | A | 4/1996 | Tomita |
| 5,532,875 | A | 7/1996 | Betensky |
| 5,625,954 | A | 5/1997 | DePaoli |
| 5,777,797 | A | 7/1998 | Miyano |
| 5,813,159 | A | 9/1998 | Kay et al. |
| 5,901,452 | A | 5/1999 | Clarkson |
| 6,295,754 | B1 | 10/2001 | Otteman et al. |
| 6,327,806 | B1 | 12/2001 | Paige |
| 6,967,775 | B1 | 11/2005 | Millett |
| 7,145,703 | B2 | 12/2006 | Sieczka et al. |
| 7,234,265 | B1 | 6/2007 | Cheng et al. |
| 7,333,270 | B1 | 2/2008 | Pochapsky et al. |
| 7,997,163 | B2 | 8/2011 | Casas |
| 8,020,335 | B2 | 9/2011 | Larsson et al. |
| 8,400,625 | B1 | 3/2013 | Young et al. |
| 8,813,410 | B2 | 8/2014 | Jung et al. |
| 2002/0186476 | A1 | 12/2002 | Sasano et al. |
| 2003/0180476 | A1 | 9/2003 | Yamashita et al. |
| 2004/0051951 | A1 | 3/2004 | Fredriksson |
| 2004/0068912 | A1 | 4/2004 | Renntoft |
| 2008/0252758 | A1 | 10/2008 | Manley |
| 2009/0168057 | A1 | 7/2009 | Gerlach |
| 2012/0102808 | A1 | 5/2012 | Matthews et al. |
| 2012/0106170 | A1 | 5/2012 | Matthews et al. |
| 2013/0263491 | A1 | 10/2013 | Jung |
| 2013/0283660 | A1 | 10/2013 | Matthews et al. |
| 2013/0333266 | A1 | 12/2013 | Gose et al. |
| 2014/0152981 | A1 | 6/2014 | Lim et al. |

OTHER PUBLICATIONS

An Official Action received from the European Patent Office dated Nov. 9, 2018 in connection with European patent application No. 14870124.6.

An extended European search Report issued by the EPO dated Mar. 22, 2017 in connection with European application No. 14870124.6.

An International Search Report and Written Opinion dated Apr. 9, 2015 in connection with PCT/KR2014/012193.

DOT SIGHTING DEVICE

CROSS REFERENCE TO RELATED APPLICATIONS

This application is a Continuation application of U.S. patent application Ser. No. 14/565,188 filed on Dec. 9, 2014, which claims priority to Korean Patent Application 10-2013-0155453 filed on Dec. 13, 2013, each of which is incorporated herein in their entirety.

BACKGROUND

The present disclosure relates to a dot sighting device with a beam splitter.

In dot-sighting devices, there are cases in which an optical axis of a reflective mirror is inclined to an optical axis of a barrel of the dot-sighting device, and thus parallax is larger than in an optical system in which an optical axis of a reflective mirror matches an optical axis of a main tube. For this reason, in order to secure a region within allowable parallax, a distance between the dot reticle and the reflective mirror needs to be increased, or the effective diameter of the reflective mirror needs to be reduced.

FIG. 1 is a diagram schematically illustrating a dot-sighting device.

As illustrated in FIG. 1, a dot-sighting device 1 includes a dot reticle generating unit 5, a reflective mirror 7, and a fixing grill 11. The dot reticle generating unit 5 includes a light-emitting element such as a light-emitting diode (LED) and a mask having a transmitting portion of a dot reticle shape positioned in front of the light-emitting element. The reflective mirror 7 reflects light emitted from the dot reticle generating unit 5 toward the user, and transmits light provided from a target, and is fixed to the side of the front end at the target side. The fixing grill 11 is used to fix the dot-sighting device to a rifle or the like.

In the dot-sighting device 1, the user aims a rifle or the like at a target by causing a dot serving as a virtual image of a dot reticle reflected by the reflective mirror 7 to match the target.

Specifically, dot reticle beams emitted from the dot reticle generating unit 5 installed in the dot sighting device 1 are reflected by the reflective mirror 7 and enter on the observer's eye in parallel. An alignment is set to match a bullet firing axis of a gun barrel. If the angle of the parallelization of the reticle beams of the dot sighting device 1 does not match the bullet firing axis of the gun barrel, although the user causes a virtual image of the dot reticle emitted from the dot reticle generating unit 5 to match a target, a bullet does not hit the target. Thus, the optical axis of the barrel has to match the bullet firing axis of the gun barrel by operating a barrel aligning knob 3 having vertical and horizontal aligning functions.

In the dot-sighting device 1, as illustrated in FIG. 1, the dot reticle generating unit 5 is arranged at the edge of the barrel not to block the user's field of vision on the target viewed through the barrel.

The parallax of light rays in the periphery of the reflective mirror 7 decreases as an angle A1 between an optical axis C1 of the barrel 10 and an optical axis C2 of the reflective mirror 7 as illustrated in FIG. 2A.

A structure in which the optical axis C1 of the barrel 10 is aligned with or (matches) the optical axis C2 of the reflective mirror 7 as illustrated in FIG. 2B is smaller in parallax than a structure in which the optical axis C1 of the barrel 10 deviates from the optical axis C2 of the reflective mirror 7 at the angle A1 as illustrated in FIG. 2B. Thus, in the structure illustrated in FIG. 2B, it is possible to reduce a distance between the dot reticle generating unit 5 and the reflective mirror 7 to be smaller than in the structure illustrated in FIG. 2A, and a compact dot sighting device can be implemented.

However, in the structure illustrated in FIG. 2B, the dot reticle generating unit 5 is arranged on the optical path of the barrel 10 of the dot sighting device 1 and blocks the user's field of vision. Thus, the structure illustrated in FIG. 2B is rarely employed.

The reflective mirror 7 is coated to reflect a light ray having a wavelength band of the dot reticle generating unit 5. This coating reflects a light ray having the wavelength band of the dot reticle generating unit 5 among external light rays incident from the outside of the reflective mirror 7. The reflected external light ray is noticeable compared to other light rays, and thus the position of the user may be easily noticed by the opponents. For example, when the dot reticle generating unit 5 employs a red LED of 650 nm as a light source, a red light ray having a wavelength band of 650 nm among external light rays is reflected by the reflective mirror 7, and the entire reflective mirror 7 is viewed in red, and thus the position of the user is likely to be easily noticed by the opponents.

BRIEF SUMMARY

The present disclosure was made in light of the foregoing, and it is an object of the present disclosure to provide a compact dot sighting device capable of reducing or minimizing parallax.

It is another object to provide a dot sighting device capable of reducing or preventing dot reticle beams emitted from a dot reticle generating unit from being reflected toward a target.

According to an embodiment of the present disclosure, an optical axis of a dot reticle generating unit is on or near the same line as an optical axis of a reflective mirror, and thus it is possible to provide a compact dot sighting device capable of reducing or minimizing parallax.

It is also possible to provide a dot sighting device capable of reducing or preventing dot reticle beams emitted from a dot reticle generating unit from being reflected toward a target.

According to another embodiment of the present disclosure, a dot sighting device includes a housing, a light source, a beam splitter and a reflective element. The housing has a first opening and a second opening. A first axis is defined from the first opening to the second opening. A second axis is defined normal to the first axis. The light source emits light. The reflective element reflects at least a portion of the light incident on the reflective element. A first light component is defined as the reflected light. The reflective element is disposed on the second axis. The beam splitter includes a surface that reflects at least a portion of the first light component of the light and transmits at least a portion of a second light component. The second light component is defined as light that enters the housing through the first opening.

According to still another embodiment of the present disclosure, a dot sighting device includes a housing, a light source, a beam splitter and a reflective element. The housing has a first opening and a second opening. A first axis is defined from the first opening to the second opening. The light source emits light. The beam splitter includes a surface that reflects at least a portion of a first light component of the light and transmits at least a portion of a second light component. The beam splitter includes a first face having an antireflective treatment. The second light component is defined as light that enters the housing through the first opening. The reflective element reflects at least a portion of the first light component reflected by the surface of the beam splitter toward the beam splitter, and transmits the second light component.

DETAILED DESCRIPTION

Figure 1:
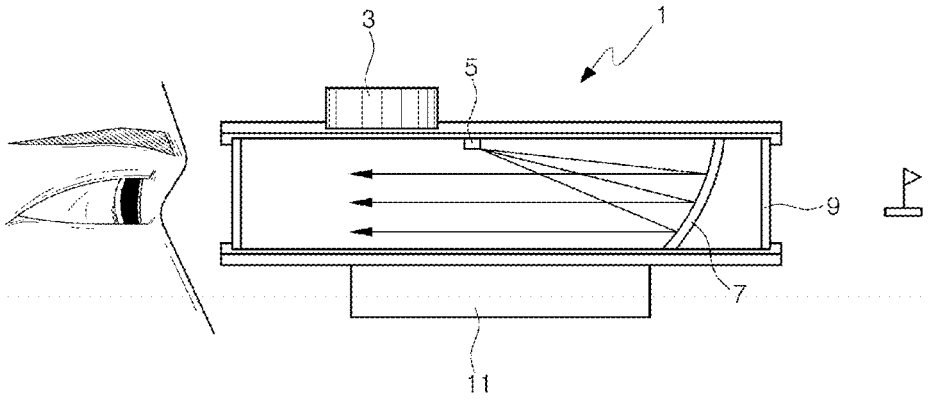
FIG. 1 is a diagram schematically illustrating a dot-sighting device.
Figure 2A:
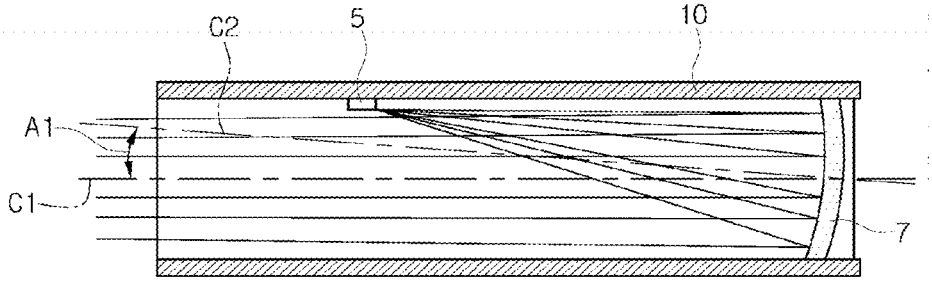
FIGS. 2A and 2B are cross-sectional views illustrating a relation between an optical axis of a reflective mirror and an optical axis of a barrel of a dot sighting device.
Figure 2B:
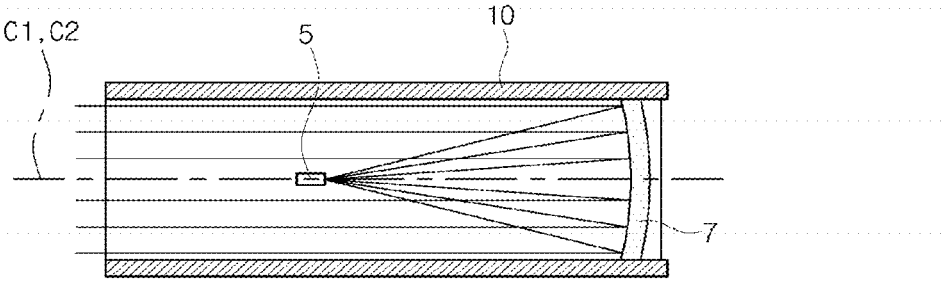

Hereinafter, preferred embodiments of the present disclosure will be described in detail with reference to the appended drawings. Note that, in this specification and the appended drawings, structural elements that have substantially the same function and structure are denoted with the same reference numerals, and repeated explanation of these structural elements is omitted.

For ease of reference, unless noted otherwise, "upper" refers to that side towards the sky under normal use conditions (e.g., distal from a gun when the dot sight is mounted to the gun) and "lower" refers to that side towards the ground under normal uses (e.g., proximal to a gun when the dot sight is mounted to the gun.) Thus, a dot sight device having a fixing grill or mount portion to fix it to a gun would typically have the fixing grill or mount portion at the lower side of the dot sight device. However, it will be appreciated that other configurations are possible such as a side mount arrangement.

First, a dot sighting device according to a first embodiment of the present disclosure will be described.

Figure 3:
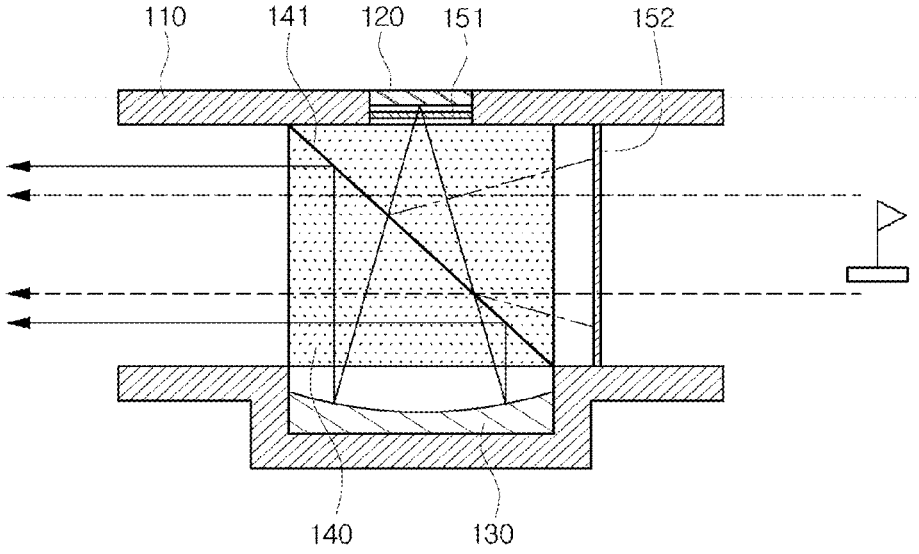
FIG. 3 is a cross-sectional schematic view illustrating a configuration of a dot sighting device according to a first embodiment of the present disclosure.

FIG. 3 is a schematic diagram illustrating a dot sighting device according to the first embodiment of the present disclosure.

Referring to FIG. 3, a dot sighting device a includes a barrel 110 arranged on a gun in parallel with a gun barrel, a dot reticle generating unit 120 arranged on one side of an inner circumferential surface of the barrel 110 (at the upper side of the barrel 110 in FIG. 3), a reflective mirror 130 that is arranged, inside the barrel 110, at the side (the lower side of the barrel 10 in FIG. 3) opposite to the dot reticle generating unit 120, and reflects dot reticle beams emitted from the dot reticle generating unit 120, a beam splitter 140 that is arranged between the dot reticle generating unit 120 and the reflective mirror 130 in the optical path and includes an inclined plane 141 that transmits dot reticle beams provided from the dot reticle generating unit 120 to reach the reflective mirror 130 and reflects incident light which is reflected toward the beam splitter 140 by the reflective mirror 130, a first polarizing unit 151 arranged between the dot reticle generating unit 120 and the beam splitter 140, and a second polarizing unit 152 arranged between inclined plane 141 and the target.

The dot reticle generating unit 120 generates a dot reticle image or a dot mask image. In order to generate a dot mask image, for example, the dot reticle generating unit 120 includes a light-emitting element such as a light-emitting diode (LED) and a mask or a reticle including a light transmitting portion of a dot reticle shape positioned in front of the light-emitting element.

The reflective mirror 130 is arranged on the inner circumferential surface of the barrel 110 at the side opposite to the dot reticle generating unit 120 so that its optical axis is positioned on the same line as the optical axis of the dot reticle generating unit 120. The reflective mirror 130 reflects dot reticle beams to be provided to the user as a virtual image. For example, the reflective mirror 130 includes a flat concave lens (or a concave flat lens) of a negative refractive power having a single reflective plane.

The beam splitter 140 is arranged between the dot reticle generating unit 120 and the reflective mirror 130, and transmits dot reticle beams provided from the dot reticle generating unit 120 to the reflective mirror 130, and reflects dot reticle beams reflected by the reflective mirror 130 toward the user. The beam splitter 140 may be configured with a beam splitting prism in which two right-angled prisms are combined. Specifically, the beam splitter 140 that passes (100-A) % of incident light and reflects A % of incident light is configured such that A % reflective coating is applied to one of two inclined planes 141 forming the boundary between the two right-angled prisms, and then the two right-angled prisms are bonded with each other. For example, when 50% reflective coating is applied to one of the two inclined planes 141, the beam splitter 140 that that passes 50% of incident light and reflects 50% of incident light is configured.

Figure 4:
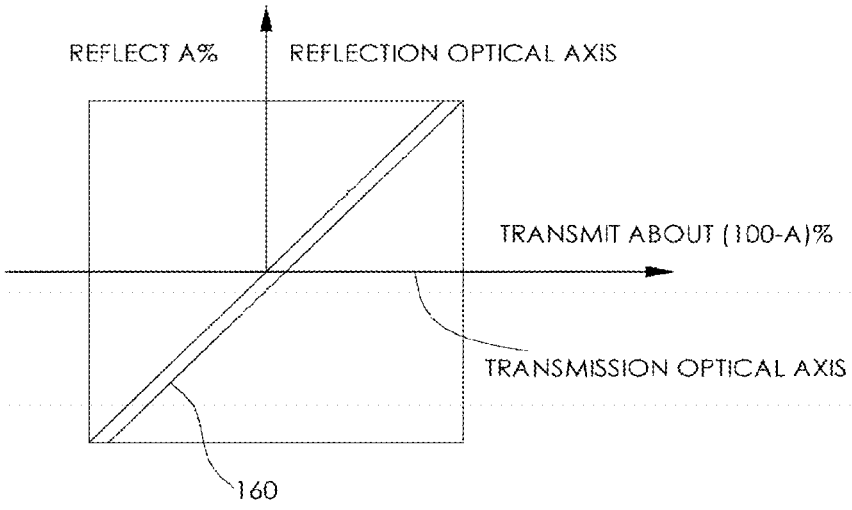
FIG. 4 is a cross-sectional schematic view illustrating another configuration of the dot sighting device according to the first embodiment of the present disclosure.

Meanwhile, as illustrated in FIG. 4, the beam splitter 140 may be configured with a beam splitting plate arranged between the dot reticle generating unit 120 and the reflective mirror 130, and the beam splitting plate has at least one reflective coating plane according to transmittance of beams.

The first polarizing unit 151 is arranged between the dot reticle generating unit 120 and the beam splitter 140, and the second polarizing unit 152 is arranged in the barrel 110 between the beam splitter 140 and the target. The first polarizing unit 151 and the second polarizing unit 152 may be configured with linear polarizers having polarization directions perpendicular to each other or circular polarizers having opposite circular polarization directions.

Next, an operation of the dot sighting device according to the first embodiment will be described.

As illustrated in FIG. 3, dot reticle beams emitted from the dot reticle generating unit 120 pass through or are reflected by the beam splitter 140 according to reflectivity of the inclined plane 141. The dot reticle beams that have passed through the inclined plane 141 are reflected by the reflective mirror 130 arranged at the side opposite to the dot reticle generating unit 120, reflected again by the inclined plane 141 of the beam splitter 140, and then enter the user's eye.

For example, when the inclined plane 141 is assumed to have a reflective coating surface of transmitting 70% of dot reticle beams and reflecting 30% of dot reticle beams, and the reflective mirror 130 is assumed to reflect 100% of light, about 21% of dot reticle beams reach the user's eye.

Meanwhile, light reflected toward the target by the inclined plane 141 do not transmit the second polarizing unit 152 arranged between the beam splitter 140 and the target since the light has already passed through the first polarizing unit 151, and the second polarizing unit 152 having the polarization direction perpendicular to or opposite to that of the first polarizing unit 151. Thus, the opponents do not notice light reflected toward the target by the inclined plane 141, and thus the position of the user is not exposed to the opponents.

In the first embodiment of the present invention, the optical axis of the reflective mirror 130 is perpendicular to the optical axis of the barrel 110, and the beam splitter 140 includes the inclined plane 141 obliquely arranged at an angle of 45° at the crossing position of the optical axis of the reflective mirror 130 and the optical axis of the barrel 110. Thus, the dot reticle beams reflected by the reflective mirror 130 are reflected in parallel with the optical axis of the barrel 110 by the inclined plane 141 of the beam splitter 140.

In other words, an effect as if the optical axis of the reflective mirror 130 were in parallel with the optical axis of the barrel 110 is obtained, and thus the parallax in the reflective mirror 130 can be reduced or minimized. Particularly, since the reflective mirror is not arranged between the user and the target, light loss occurring when passing through the coating surface of the reflective mirror in the related art does not occur or is otherwise reduced, and thus the color of a field of vision secured from the external target and the surrounding area does not remarkably change. Further, since the first polarizing unit 151 and the second polarizing unit 152 are arranged, it is possible to prevent the position of the user from being exposed by the opponents due to reflection by the outer surface of the reflective mirror 130.

In addition, since the length of the barrel 110 can be reduced, a compact and light dot sighting device can be implemented.

The present embodiment has been described in connection with the example in which the beam splitter 140 is arranged together with the first polarizing unit 151 and the second polarizing unit 152, but the first polarizing unit 151 and the second polarizing unit 152 may be removed in a situation in which the position of the user is allowed to be exposed to the opponents.

Figure 5A:
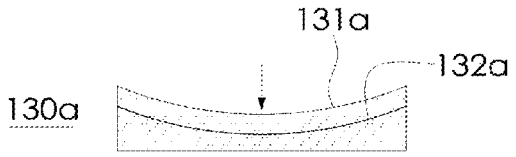
FIGS. 5A to 5D are side views illustrating various forms of reflective mirrors.
Figure 5B:
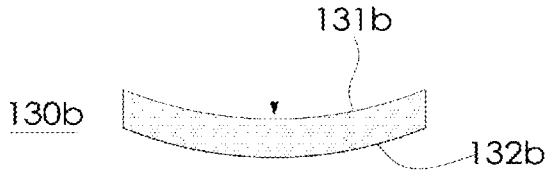
Figure 5C:
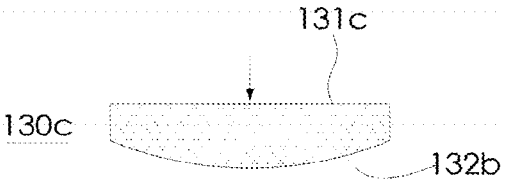
Figure 5D:
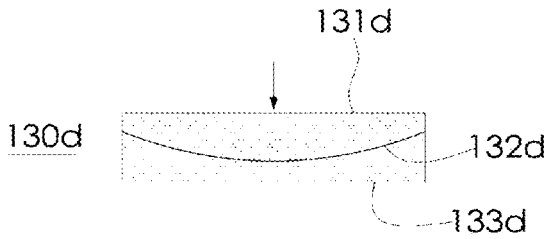

The present embodiment has been described in connection with the example in which the reflective mirror 130 is configured with a concave singlet having a single reflective surface, but the reflective mirror 130 can have various forms of configurations as illustrated in FIGS. 5A to 5D. As illustrated in FIG. 5A, a reflective mirror 130*a* may be configured with a doublet lens in which reflective coating is applied to any one of a first concave surface 131*a* on which dot reticle beams are incident and a second concave surface 132*a*. As illustrated in FIG. 5B, a reflective mirror 130*b* may be configured with a singlet lens in which reflective coating is applied to any one of a first concave surface 131*b* on which dot reticle beams are incident and a second convex surface 132*b*. As illustrated in FIG. 5C, a reflective mirror 130*c* may be configured with a singlet lens in which a first surface 131*b* on which dot reticle beams are incident is planar, and a second surface 132*b* is convex. Further, as illustrated in FIG. 5D, a reflective mirror 130*d* may be configured with a doublet lens in which a first surface 131*d* on which dot reticle beams are incident is planar, and reflective coating is applied to a second surface 132*d* or a third surface 133*d*. Furthermore, when the first surface 131*c* or 131*d* on which dot reticle beams are incident is planar as illustrated in FIG. 5C or 5D, the reflective mirror 130*c* or 130*d* may be configured integrally with the beam splitter 140 such that the first surface 131*c* or 131*d* is bonded to the facing plane of the beam splitter 140, for example, by a balsam bonding technique.

Next, a dot sighting device according to a second embodiment of the present disclosure will be described.

Figure 6:
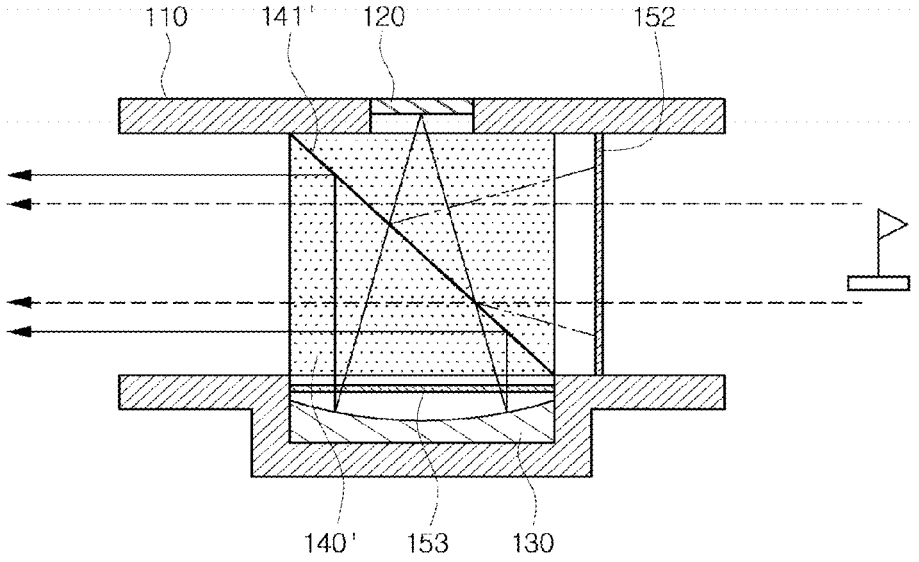
FIG. 6 is a cross-sectional schematic view illustrating a configuration of a dot sighting device according to a second embodiment of the present disclosure.

FIG. 6 is a schematic diagram illustrating a dot sighting device according to the second embodiment of the present disclosure.

Referring to FIG. 6, a difference of the dot sighting device from that of the first embodiment is that a beam splitter 140' is configured with a polarization beam splitting (PBS) prism, a third polarizing unit 153 configured with a $\lambda/4$ plate (quarter wave plate) is arranged between the beam splitter 140' and a reflective mirror 130, and a second polarizing unit 152 configured with a linear polarizer is arranged between the beam splitter 140' and the target.

Figure 7:
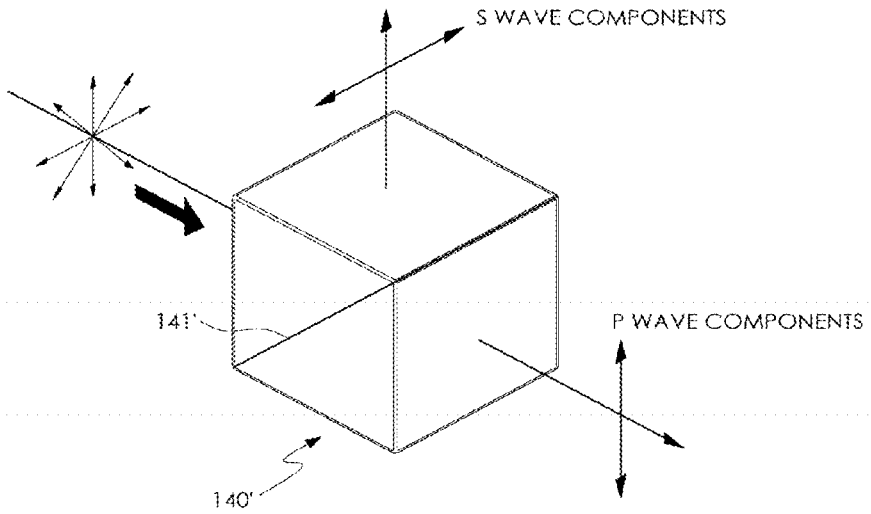
FIG. 7 is a perspective schematic view illustrating a configuration of a beam splitter according to a second embodiment of the present disclosure.

The beam splitter 140' configured with the PBS prism includes an inclined plane 141', and the inclined plane 141' has a coating surface set to reflect S wave components (that is, S-polarized components) and transmit P wave components (that is, P-polarized components) among dot reticle beams (arrow), and the second polarizing unit 152 is set to block the S wave components as illustrated in FIG. 7.

The coating surface of the inclined plane 141' may be set to reflect a certain proportion (for example, 60%) of S wave components, transmit the remaining proportion (for example, 40%) of S wave components, and transmit 100% of P wave components so that a total amount of transmitted S wave components and transmitted P wave components is more than 50% (for example, 70%).

Next, an operation of the dot sighting device according to the second embodiment of the present disclosure will be described.

Referring to FIG. 6, dot reticle beams emitted from the dot reticle generating unit 120 are incident on the inclined plane 141' of the beam splitter 140'. Since the inclined plane 141' of the beam splitter 140' is set to reflect the S wave components and transmit the P wave components among the dot reticle beams incident on the inclined plane 141', the P wave components pass through the inclined plane 141' to reach the reflective mirror 130 at the side opposite to the dot reticle generating unit 120, and the S wave components are reflected by the inclined plane 141' to be directed toward the target.

The P wave components being directed toward the reflective mirror 130 after passing through the beam splitter 140' are converted into right-handed circularly polarized S wave components (or left-handed circularly polarized S wave components) through the first λ/4 plate 153 arranged between the beam splitter 140' and the reflective mirror 130. The right-handed circularly polarized S wave components (or left-handed circularly polarized S wave components) are reflected by the reflective mirror 130 to be directed toward the inclined plane 141', then reflected by the inclined plane 141' to be directed toward the user. Thus, the user can aim at the target by aligning a dot reticle image (light beams) that has been emitted and reflected by the reflective mirror 130 with the target viewed through the beam splitter 140'.

Meanwhile, dot reticle beams (S wave components) emitted from the dot reticle generating unit 120 may be reflected by the inclined plane 141' and towards opponents. However, in the present embodiment, the S wave components reflected by the inclined plane 141' to be directed toward the target are blocked by the second polarizing unit 152, and thus the position of the user can be prevented from being exposed to the opponents.

According to the second embodiment of the present disclosure, since the beam splitter 140' is configured with the PBS prism, a quantity of light lost in the beam splitter 140' is smaller than in the beam splitter 140 according to the first embodiment, and thus the user can clearly view the dot reticle image.

Next, a dot sighting device according to a third embodiment of the present disclosure will be described.

Figure 8:
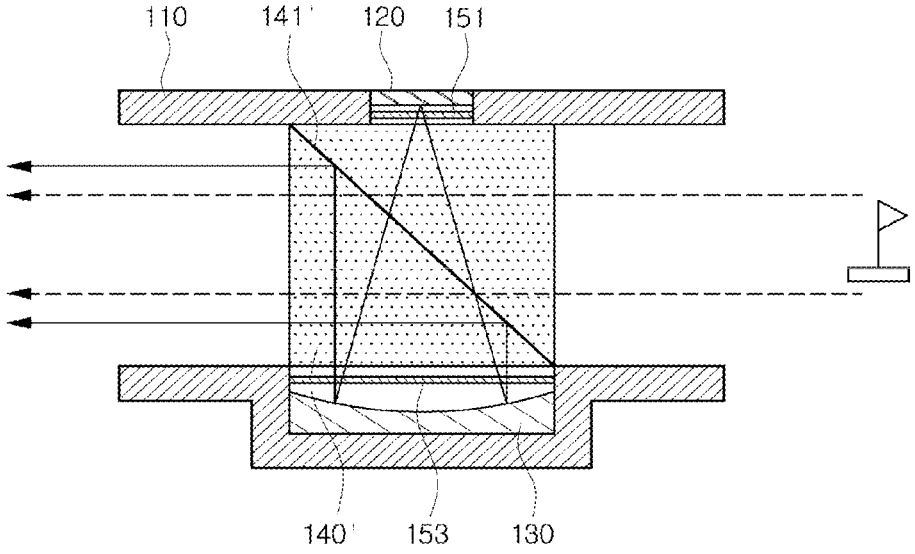
FIG. 8 is a cross-sectional schematic diagram illustrating a configuration of a dot sighting device according to a third embodiment of the present disclosure.

FIG. 8 is a schematic diagram illustrating a dot sighting device according to the third embodiment of the present disclosure.

Referring to FIG. 8, a difference of the dot sighting device from that of the first embodiment is that a beam splitter 140' is configured with a PBS prism, a first polarizing unit 151 configured with a linear polarizer is arranged between a dot reticle generating unit 120 and the beam splitter 140', and a λ/4 plate (quarter wave plate) 153 is arranged between the beam splitter 140' and a reflective mirror 130.

The beam splitter 140' includes an inclined plane 141' with a coating surface set to reflect S wave components (that is, S-polarized components) and transmit P wave components (that is, P-polarized components), and the first polarizing unit 151 arranged between the dot reticle generating unit 120 and the beam splitter 140' is set to transmit only P wave components.

The coating surface of the inclined plane 141 may be set to reflect a certain proportion (for example, 60%) of S wave components, transmit the remaining proportion (for example, 40%) of S wave components, and transmit 100% of P wave components so that a total amount of transmitted S wave components and transmitted P wave components is more than 50% (for example, 70%).

Next, an operation of the dot sighting device according to the third embodiment of the present disclosure will be described.

Referring to FIG. 8, among dot reticle beams emitted from the dot reticle generating unit 120, S wave components are blocked by the first polarizing unit 151, and P wave components pass through the first polarizing unit 151 to be directed toward the beam splitter 140'.

The P wave components that have passed through the first polarizing unit 151 pass through the inclined plane 141' of the beam splitter 140', and then converted into right-handed circularly polarized light beams or left-handed circularly polarized light beams through the λ/4 plate 153 arranged between the beam splitter 140' and the reflective mirror 130. Then, the right-handed circularly polarized light beams or the left-handed circularly polarized light beams are reflected by the reflective mirror 130 and then converted into S wave components by the λ/4 plate 153. Then, the S wave components are reflected by the inclined plane 141' to be directed toward the user. Thus, the user can aim at the target by aligning a dot reticle image (light beams) that has been emitted and reflected by the reflective mirror 130 with the target viewed through the beam splitter 140'.

As described above, the inclined plane 141' of the beam splitter 140' includes the coating surface set to reflect S wave components and transmit P wave components. Here, when the dot reticle beams emitted from the dot reticle generating unit 120 toward the beam splitter 140' are incident on the inclined plane 141' of the beam splitter 140' in the vertical direction, since the inclined plane 141' blocks the S wave components and transmits the P wave components, the dot reticle beams can be prevented from being reflected toward the target.

However, as illustrated in FIG. 8, since the dot reticle beams emitted from the dot reticle generating unit 120 are incident on the inclined plane 141' of the beam splitter 140' at a certain emission angle (for example, about 45°), it is difficult to perfectly split the S wave components and the P wave components, that is, block the S wave components and transmit the P wave components through the first polarizing unit 151. In other words, some P wave components may be reflected by the inclined plane 141' to be directed toward the target, and thus the position of the user may be exposed.

In order to solve this problem, in the present embodiment, the beam splitter 140' is configured to have a coating surface capable of splitting the S wave components and the P wave components, that is, block the S wave components and transmit the P wave components on light components incident at a certain angle (for example, about 5° from a vertical line to each of the left and the right (that is, about 10°) equal to or smaller than a certain emission angle among the dot reticle beams that are emitted from the dot reticle generating unit 120 and incident on the inclined plane 141' of the beam splitter 140' on the certain emission angle (for example, about 45°). As a result, it is possible to prevent some light components from being directed toward the target, whereby the position of the user is not exposed.

When the coating surface is set to split the S wave components and the P wave components at the entire emission angle of the dot reticle generating unit, it is possible to more reliably prevent some light components from being reflected by the inclined plane 141' of the beam splitter 140' and directed toward the target, whereby the position of the user is not exposed. However, this configuration may have higher costs, and longer manufacturing times. Thus, for example, the coating surface may be set to split the S wave components and the P wave components at an angle equal to or smaller than the emission angle, preferably about 5° from a vertical line to each of the left and the right (that is, about 10°).

In this case, when the dot sighting device is close to the target, the position of the user may be exposed, but the position of the user is unlikely to be exposed at a certain distance or more from the target. In other words, it is desirable that an angle at which the coating surface can split the S wave components and the P wave components, that is, block the S wave components and transmit the P wave components be set according to the purpose of the dot sighting device.

As described above, the first polarizing unit 151 that blocks the S wave components is arranged between the dot reticle generating unit 120 and the beam splitter 140', and the inclined plane 141' of the beam splitter 140' is set to transmit the P wave components and reflect the S wave components, and thus it is possible to prevent the position of the user from being exposed to the opponents around the target (or reduce the likelihood of this occurrence).

According to the third embodiment of the present disclosure, since a polarizing unit is not arranged between the beam splitter 140' and the target, incident light provided from the target is provided to the user "as is," and thus the user can vividly observes the target.

In the second and third embodiments of the present disclosure, instead of the PBS prism, two beam splitting plates with a coating surface capable of splitting polarized beams (the S wave components and the P wave components) therebetween may be used.

Meanwhile, when ambient light is incident on a prism, 4 side surfaces of the prism glare or glitter due to total internal reflection, and thus it makes it difficult for the observer to clearly view the target. In other words, the total internal reflection occurs on the 4 side surfaces of the prism when the user views the target through the prism, and thus a phenomenon that the 4 side surfaces of the prism glare or glitter in the sun or strong light such as a mirror occurs. This phenomenon may make it difficult for the observer to observe the target through the prism.

Figure 9:
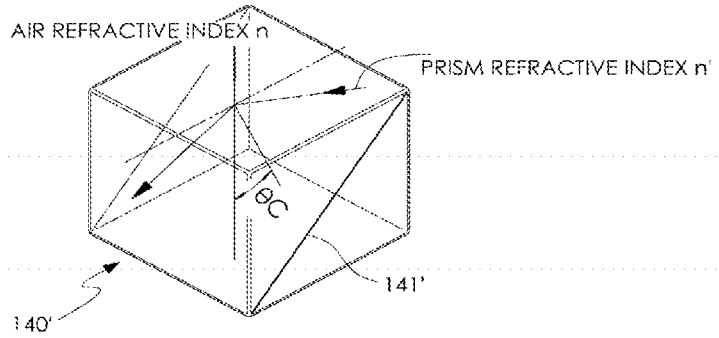
FIG. 9 is a perspective conceptual diagram illustrating an example of total internal reflection.

Total internal reflection occurs when a medium having a high refractive index (for example, a prism having a refractive index n') causes light to refract to a medium having a low refractive index (for example, air having a refractive index n=1) as illustrated in FIG. 9. An incident angle at which the total internal reflection occurs is referred to as a "total internal reflection critical angle $\theta_c$." The total internal reflection critical angle $\theta_c$ is decided as follows:

$$\theta_c = \sin^{-1}\left(\frac{n}{n'}\right)$$

Light incident on the side surface of the prism at the critical angle or more undergoes total internal reflection as illustrated in FIG. 9, and thus there is a phenomenon that the side surface of the prism glares or glitters.

Figure 10:
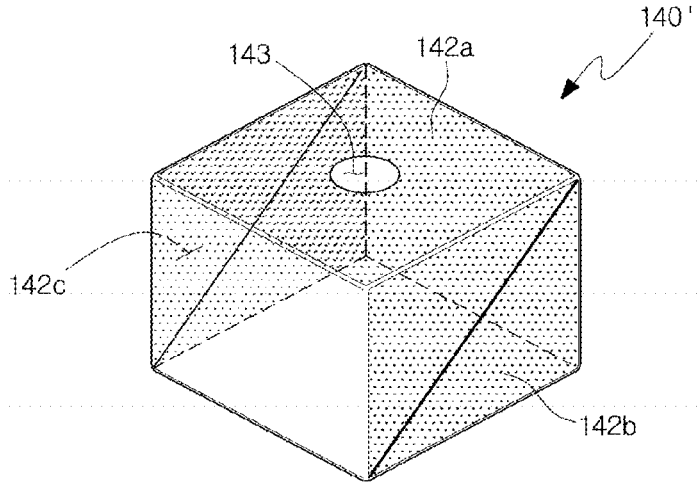
FIG. 10 is a perspective view illustrating an example of an anti-reflective treatment.

In order to mitigate or solve this problem, an anti-reflective treatment for preventing the total internal reflection is applied to outer surfaces 142*a*, 142*b*, and 142*c* on which reflection or transmission of the prism configuring the beam splitter 140' is not performed as illustrated in FIG. 10. In other words, the anti-reflective treatment for reducing or preventing the total internal reflection is applied to the surfaces (e.g., 142*b* and 142*c*) of the prism and/or portions thereof that do not relate to an optical path that light emitted from the dot reticle generating unit 120 passes through (e.g., a part of the surface (e.g., 142*a*) of the prism close to the dot reticle generating unit 120) and an optical path through which light from the target passes. In this case, the dot reticle generating unit 120 is arranged at the side of the outer surface 142*a*, and the reflective mirror 130 is arranged at the side opposite to the outer surface 142*a*. Note that the term "applied" is not limited to the application of another material to the surface but also includes other treatments such as the application (e.g., carrying out) of a process that changes a property of the surface.

Specifically, examples of the anti-reflective treatment include a process of forming irregular portions (e.g., tiny or fine concave-convex portions or uneven portions) on the relevant surfaces of the beam splitter and a process of forming an anti-reflective layer on the relevant surfaces of the beam splitter. As an example, the portions of the surfaces on the optical path of light emitted from the dot reticle and the portions of the optical path through which light from the target passes may be smoother than (e.g., less rough, more regular, not as irregular as) those portions of surfaces not on those optical paths. As another example, an antireflective film may be applied to the portions of the surfaces on the optical path of light emitted from the dot reticle and the portions of the optical path through which light from the target passes and not applied to those portions of surfaces not on those optical paths. As still another example, a film may be applied having a different reflectivity property (e.g., permitting more transmission or reflection) at portions of the surfaces on the optical path of light emitted from the dot reticle and the portions of the optical path through which light from the target passes as compared to the film at those portions of surfaces not on those optical paths.

The process of forming the irregular portions (e.g., tiny or fine concave-convex portions or uneven portions) on the upper surface 142*a* and the left and right side surfaces 142*b* and 142*c* may be, for example, a sandblasting process or a grinding process. The irregularities (e.g., tiny or fine concave-convex portions or uneven portions) may scatter reflections when light such as ambient light is incident thereon, thereby reducing or preventing the total internal reflection. The irregularities (e.g., tiny or fine concave-convex portions or uneven portions) preferably have a height and an interval of about one tenth (1/10) of the wavelength of ambient light (e.g., a wavelength of approximately 55 nm), for example, a height of 0.05 μm to 5 μm and an interval of 0.05 μm to 5 μm.

Figure 14:
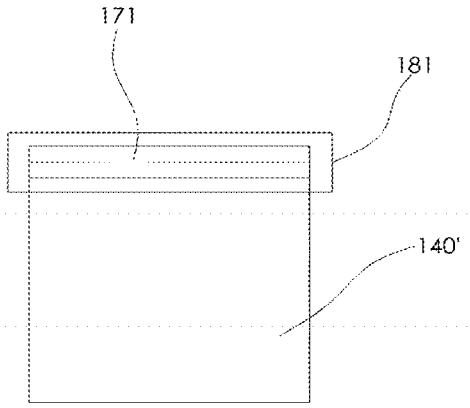
FIG. 14 is a side view of an exemplary beam splitter.

Referring to FIG. 14, the process of forming an anti-reflective layer on the relevant surfaces of the beam splitter may be performed by forming a light absorbing layer 181 on, for example, the upper surface 142*a* and the left and right side surfaces 142*b* and 142*c*. The light absorbing layer may be formed of a light absorbing material such as a black matt pigment or material. The light absorbing layer absorbs incident light and thus helps to reduce or prevent the total internal reflection. Further, a transparent material layer 171 may be interposed between the light absorbing layer 181 and the relevant surface of the beam splitter 140'. In this case, ambient light may be induced to be incident on a side portion of the light absorbing layer 181 while passing through the transparent material layer 171, and thus the total internal reflection can be more effectively reduced or prevented. The transparent material layer 171 may have one or more layers. As the number of layers constituting the transparent material layer 171 increases, the effect of reducing or preventing the total internal reflection increases. The transparent material layer 171 may be made of a transparent material such as $TiO_2$, $SiO_2$, or $NgF_2$.

It will be appreciated that both the process of forming irregularities (e.g., tiny or fine concave-convex portions or uneven portions) and the process of forming the anti-reflective layer may be performed together on one of more of the relevant surfaces of the beam splitter as the anti-reflective treatment. The beam splitter may also include different processes applied to different of the relevant surfaces as the antireflective treatment.

For example, as the anti-reflective treatment, a sandblasting process or a grinding process may be performed on the upper surface 142*a* and the left and right side surfaces 142*b* and 142*c* of the beam splitter 140' to form irregularities (e.g., tiny or fine concave-convex portions or uneven portions) on the upper surface 142*a* and the left and right side surfaces 142*b* and 142*c*. As another example or in addition, the anti-reflective layer 181 (and the transparent material layer 171) may be formed on the upper surface 142*a* and the side surfaces 142*b* and 142*c*, or the upper surface 142*a*. The side surfaces 142*b* and 142*c* may also be painted or coated with, for example, a black matt pigment or material. As a result, it is possible to reduce or prevent the total internal reflection phenomenon from occurring on the upper surface 142*a* and the side surfaces 142*b* and 142*c* of the beam splitter 140'. At this time, a light transmitting portion 143 having a diameter of about 5 mm is not subjected to the anti-reflective treatment. For example, a circular-shaped protection film having a diameter of about 5 mm such as a metallic plate is removably attached onto a portion of the outer surface 142*a* corresponding to the position of the dot reticle generating unit 120, and square-shaped protection films are removably attached on the other surfaces that are not to be treated (e.g., the front and rear surfaces). Preferably the protection films are not applied to the side surfaces 142*b* and 142*c*. Thereafter, for example, the sandblasting process of blasting an abrasive material such as sand against the prism under the high pressure is performed, and then the protection films are removed. As a result, a surface having tiny or fine concave-convex portions or uneven portions capable of reducing or preventing the effect of total internal reflection can be formed on the upper surface 142*a* (except for the portion covered by the protection film) and the side surfaces 142*b* and 142*c* of the beam splitter 140'. In FIG. 10, the light transmitting portion 143 has a circular shape, but the light transmitting portion 143 is not limited to the circular shape and may have various shapes.

Meanwhile, when there is an air layer between the beam splitter 140 or 140' and the reflective mirror 130, since the refractive index n is increased due to the air layer, total internal reflection of light reflected by the interface between the beam splitter 140 or 140' and the air layer may occur.

Figure 12:
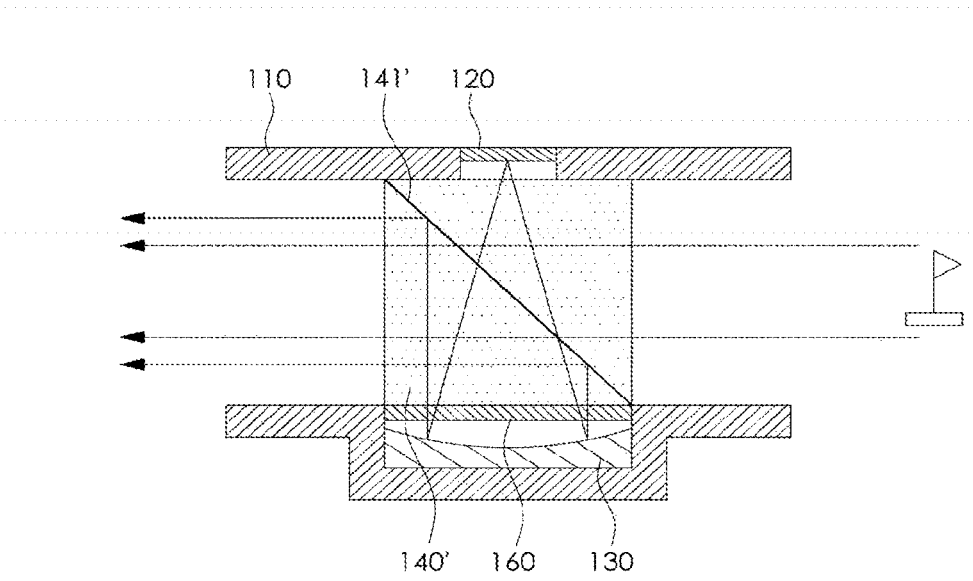
FIG. 12 is a cross-sectional schematic view illustrating another configuration of a dot sighting device according to an embodiment of the present disclosure.

In order to reduce or prevent this phenomenon, after the anti-reflective treatment is performed on the upper surface 142*a* and the side surfaces 142*b* and 142*c*, for example, as illustrated in FIG. 12, a lens glass or a planar glass 160 having a certain thickness is preferably attached to the lower surface of the beam splitter 140' (or 140) without an air gap. The reflective mirror 130 may be bonded by, for example, the balsam bonding technique. In this case, light may not reflect at an interface between the beam splitter 140' and the lens glass or the planar glass 160, and even though ambient light may be reflected by an interface between the lens glass or the planar glass 160 and the air layer. Reflected light may be blocked by the barrel of the dot sight device and does not reach the observer's eyes, so that the total internal reflection is reduced or prevented.

In the second and third embodiments, the λ/4 plate may be interposed between the lens glass or the planar glass 160 and the reflective mirror 130.

Figure 13:
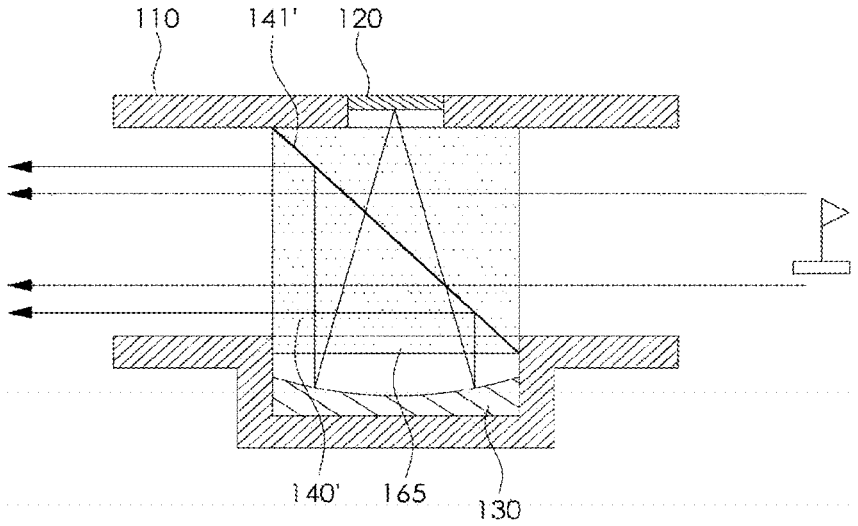
FIG. 13 is a cross-sectional schematic view illustrating another configuration of a dot sighting device according to an embodiment of the present disclosure.

Alternatively, in order to reduce or prevent total internal reflection occurring due to the air layer between the beam splitter and the air layer, for example, as illustrated in FIG. 13, a part 165 of the beam splitter 140' (140) may be preferably inserted into the barrel of the dot sight device. Due to the part 165 of the beam splitter 140' (140), even though ambient light is reflected by the interface between the part 165 of the beam splitter 140' (140) and the air layer formed between the part 165 and the reflective mirror 130, reflected light is blocked by the internal wall of the barrel, and thus some or all of reflected light may not reach the observer's eyes. As an example, if in the case of the beam splitter having the size of 30 mm×30 mm, in order to substantially reduce or completely prevent total internal reflection occurring due to the air layer between the beam splitter and the reflective mirror, the planar glass 160 or the part 165 has to have the vertical length (or the height) of about 17 mm. But, 17 mm is too large to be practical. Good results can be obtained when the planar glass 160 or the part 165 preferably has the vertical length (or the height) of about 10 mm. Thus, preferably, the vertical length (or height) is at least one third of the height of the beam splitter.

Figure 11:
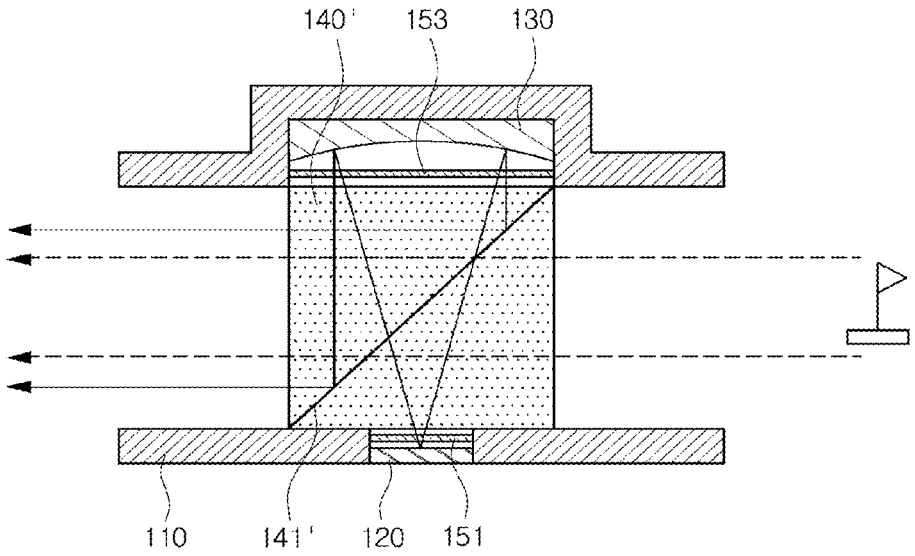
FIG. 11 is a cross-sectional schematic view illustrating another configuration of a dot sighting device according to an embodiment of the present disclosure.

The lens glass or the planar glass 160 and the part 165 of the beam splitter 140' (or 140) can be applied regardless of the position of the reflective mirror 130, that is, regardless of whether the reflective mirror 130 is positioned below or above the beam splitter or at the side of the beam splitter. For example, the lens glass or the planar glass 160 and the part 165 of the beam splitter 140' (or 140) can be applied to the dot sight device in which the reflective mirror 130 is arranged above the beam splitter 140 as illustrated in FIG. 11.

Meanwhile, when the beam splitter 140' is configured with a beam splitting plate or a polarization beam splitting plate, the anti-reflective treatment may be performed on the side surface (e.g., 142*b*, 142*c*) of the plate.

FIG. 8 illustrates the configuration in which the reflective mirror 130 is arranged below the beam splitter 140', but the positions of the reflective mirror 130 and the dot reticle generating unit 120 are not particularly limited. The reflective mirror 130 and the dot reticle generating unit 120 are preferably arranged at opposite sides. For example, the reflective mirror 130 may be arranged at the left (or right) side surface, and the dot reticle generating unit 120 may be arranged at the right (or left) side surface opposite to the side at which the reflective mirror 130 is arranged. Further, the reflective mirror 130 may be arranged at the upper side, and the dot reticle generating unit 120 may be arranged at the lower side opposite to the side at which the reflective mirror 130 is arranged as illustrated in FIG. 11. In the case of the configuration of FIG. 8 in which the reflective mirror 130 is arranged at the lower side, and the dot reticle generating unit 120 is arranged at the upper side, there may be certain circumstances in which the user does not clearly view the target due to reflection by the reflective mirror 130. In particular, when a light source (for example, a lamp or the sun) is located above the user, light is incident on the reflective mirror 130 downward, and the reflected light enters the user's eyes. This may make it difficult for the user to clearly view the target. Particularly, in the outdoor circumstance in which the sunshine is bright, it may be difficult for the user to clearly view the target. However, in the case of the configuration of FIG. 11 in which the reflective mirror 130 is arranged at the upper side, and the dot reticle generating unit 120 is arranged at the lower side, light is prevented from being incident on reflective mirror 130 downward, and thus the user can view the target more clearly than the configuration in which the reflective mirror 130 is arranged at the lower side and the dot reticle generating unit 120 is arranged at the upper side. Particularly, even in the outdoor circumstance in which the sunshine is bright, the user may view the target more clearly.

The dot reticle generating unit 120 may be configured with a display device such as an OLED, an LCD, an LCOS, or the like to display a dot reticle shape instead of an LED.

According to the present disclosure, since the optical axis of the dot reticle generating unit 120 is near or on the same line as the optical axis of the reflective mirror 130, it is possible to reduce parallax, and it is possible to implement a more compact dot sighting device.

Further, it is possible to provide a dot sighting device capable of reducing to preventing the dot reticle beams emitted from the dot reticle generating unit 120 from being reflected and directed toward the target and thus helping to keep the position of the user from being exposed to the opponents.

In addition, since the reflective mirror is not arranged between the beam splitter and the target, light loss occurring when passing through the coating surface of the reflective mirror may be avoided, a sense of color on a field of vision secured from the external target and the surrounding area does not remarkably change, and a natural sense of color is provided to the user.

Although the present invention has been described in detail according to the embodiments, it is not limited to the above the embodiments. It will be understood by those of ordinary skill in the art that the embodiments may be partially or totally combined with each other and various modifications of the embodiments may be made without departing from the scope of the subject matter of the present invention.

Further, the embodiments discussed have been presented by way of example only and not limitation. Thus, the breadth and scope of the invention(s) should not be limited by any of the above-described exemplary embodiments, but should be defined only in accordance with the following claims and their equivalents. Moreover, the above advantages and features are provided in described embodiments, but shall not limit the application of the claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called technical field. Further, a description of a technology in the "Background" is not to be construed as an admission that technology is prior art to any invention(s) in this disclosure. Neither is the "Brief Summary" to be considered as a characterization of the invention(s) set forth in the claims found herein. Furthermore, any reference in this disclosure to "invention" in the singular should not be used to argue that there is only a single point of novelty claimed in this disclosure. Multiple inventions may be set forth according to the limitations of the multiple claims associated with this disclosure, and the claims accordingly define the invention(s), and their equivalents, that are protected thereby. In all instances, the scope of the claims shall be considered on their own merits in light of the specification, but should not be constrained by the headings set forth herein.

What is claimed is:

1. A dot sighting device, comprising:

a housing having a first opening and a second opening, a first axis being defined from a center of the first opening to a center of the second opening, and a second axis being defined normal to the first axis;

a light source that emits light and disposed substantially parallel to the second axis;

a reflective element disposed substantially parallel to the second axis, the reflective element having a first surface disposed proximal to the light source and a second surface disposed distal to the light source, and the first surface of the reflective element being configured to reflect at least a portion of the light incident on the reflective element;

a beam splitter disposed between the light source and the reflective element; and a polarizer disposed substantially parallel to the first axis and configured to limit the light projected by the light source towards a target.

2. The dot sighting device of claim 1, wherein the reflective element includes a flat concave lens.

3. The dot sighting device of claim 2, wherein the first surface of the reflective element includes a concave surface of the flat concave lens.

4. The dot sighting device of claim 2, wherein the second surface of the reflective element includes a flat surface of the flat concave lens.

5. The dot sighting device of claim 1, wherein the reflective element includes a doublet, and the first surface is disposed between lenses of the doublet.

6. The dot sighting device of claim 5, wherein first and second surfaces of the doublet disposed on the second axis respectively include planar surfaces.

7. The dot sighting device of claim 1, wherein the first surface of the reflective element includes a concave surface.

8. The dot sighting device of claim 7, wherein the second surface of the reflective element includes a convex surface.

9. The dot sighting device of claim 1, wherein the first surface of the reflective element includes a planer surface.

10. The dot sighting device of claim 1, further comprising a planar element coupled to a surface of the beam splitter, the planar element being disposed between the beam splitter and the reflective element.

11. The dot sighting device of claim 10, wherein a third axis is defined parallel to the first axis, and the housing and the planar element are respectively disposed on the third axis.

12. The dot sighting device of claim 10, wherein the planar element is coupled to the surface of the beam splitter without an air gap between the planar element and the beam splitter.

13. The dot sighting device of claim 1, further comprising a mounting portion operable to couple the housing to a firearm, wherein the mounting portion is disposed at a first side of the housing, and the reflective element is disposed at a second side of the housing.

14. A dot sighting device, comprising:

a housing having a first opening and a second opening, a first axis being defined from a center of the first opening to a center of the second opening, and a second axis being defined normal to the first axis;

a light source that emits light and disposed substantially parallel to the second axis;

a reflective element disposed substantially parallel to the second axis, the reflective element having a first surface disposed proximal to the light source and a second surface disposed distal to the light source;

a beam splitter disposed between the light source and the reflective element; and a planar element coupled to a surface of the beam splitter, the planar element being disposed between the beam splitter and the reflective element.

15. The dot sighting device of claim 14, wherein a third axis is defined parallel to the first axis, and the housing and the planar element are respectively disposed on the third axis.

16. The dot sighting device of claim 14, wherein the planar element is coupled to the surface of the beam splitter without an air gap between the planar element and the beam splitter.

17. The dot sighting device of claim 14, wherein the first surface of the reflective element is configured to reflect at least a portion of the light incident on the reflective element.

18. The dot sighting device of claim 17, wherein the reflective element includes a flat concave lens, and the first surface of the reflective element includes a concave surface of the flat concave lens.

19. The dot sighting device of claim 17, wherein the reflective element includes a doublet, and the first surface is disposed between lenses of the doublet.

20. The dot sighting device of claim 14, further comprising a mounting portion operable to couple the housing to a firearm, wherein the mounting portion is disposed at a first side of the housing, and the reflective element is disposed at a second side of the housing.

* * * * *